United States Patent [19]

Belcher

[11] Patent Number: 4,497,114

[45] Date of Patent: Feb. 5, 1985

[54] APPARATUS FOR APPLYING DESIGNS TO WALL STRUCTURE

[76] Inventor: Joe D. Belcher, 6232 Christiana Ct., Orlando, Fla. 32810

[21] Appl. No.: 486,918

[22] Filed: Apr. 20, 1983

[51] Int. Cl.[3] ..... B43L 13/02; E04G 21/20

[52] U.S. Cl. ..... 33/41 D; 15/235.3; 30/172

[58] Field of Search ..... 33/41 D, 44; 15/235.3, 15/235.4, 235.5, 235.6; 30/172

[56] References Cited

U.S. PATENT DOCUMENTS

| | | | |
|---|---|---|---|
| 531,243 | 12/1894 | Wilson | 15/235.3 |
| 878,293 | 2/1908 | Kadan | 33/41 D |
| 923,834 | 6/1909 | Harrop | 15/235.3 |
| 1,027,396 | 5/1912 | Abram | 15/235.3 |
| 1,202,780 | 10/1916 | Black | 33/41 D |
| 1,616,087 | 2/1927 | Johnson | 15/235.3 |
| 2,947,084 | 8/1960 | Billings | 15/235.3 |
| 3,758,945 | 9/1973 | Finnegan, Jr. | 15/235.3 |

FOREIGN PATENT DOCUMENTS

| | | | |
|---|---|---|---|
| 483496 | 5/1952 | Canada | 15/235.3 |

*Primary Examiner*—Richard R. Stearns
*Attorney, Agent, or Firm*—William M. Hobby, III

[57] ABSTRACT

An apparatus for applying brick designs to a wall surface has a handle attached to a frame with a plurality of blade holders attached to and extending from the frame. A plurality of blades are removably attached to the blade holders and are specially shaped for producing brick designs on wall surfaces, such as stucco, cement, or plaster veneered surfaces, or the like.

6 Claims, 5 Drawing Figures

10
11
12
13
14
15
16
17
18
20
21
22
23
24
25
26

18
22
23
24
25
26

32
33
34
35
36
37
38

12
16
17
24
25
26

10
27
28
30
31

APPARATUS FOR APPLYING DESIGNS TO WALL STRUCTURE

BACKGROUND OF THE INVENTION

The present invention relates to an apparatus for applying brick designs to a wall surface and especially to a wall surfaced with stucco, cement, plaster, mortar, or the like.

In the past, it has been common to provide wall surfaces which imitate a variety of material and it is especially common to imitate a brick wall surface. This has become even more common as the price of building a wall with a brick facade has become more expensive. To avoid the high cost of masonry bricks, various types of brick veneers have been provided which can be attached to an existing wall with adhesives, or the like, to imitate the brick surface with a variety of materials including a kiln hardened brick surface which has only a fraction of the thickness of the brick. There have been a variety of tools for producing a wall with a bricklike surface, including the Keast U.S. Pat. No. 2,602,232 for an apparatus for applying designs to wall structures; and the Johnson U.S. Pat. No. 1,616,087 for a cement marker which has a handle and a single blade for marking cement. The Kennedy U.S. Pat. No. 1,646,150 teaches a stucco joiner; while the Kelly U.S. Pat. No. 1,589,703 is for a brick joiner for producing uniform cement joints between layers in a brick wall.

The present invention deals with a simplified tool for producing an imitation brick wall in a wall coated with plaster, cement, stucco, or other material, which advantageously allows for the addition or removal of blades for producing both the horizontal and vertical lines in the wall to simulate the joints between bricks. Thus, a tool with four blades can produce four horizontal joints and the two middle blades can be removed so that the two end blades can be used to produce the vertical joints, and thereby rapidly produce a simulated brick wall with only a single tool.

SUMMARY OF THE INVENTION

An apparatus for applying brick designs to a wall surface, such as a stucco, cement, plaster, or mortar wall surface has a frame having a handle attached thereto. The frame has a plurality of blade holders attached thereto and extending therefrom which may be removably attached to the frame. The plurality of blades are removably attached to the blade holders and may have a U-shape with a flat bottom portion for cutting brick joint designs into the wall surface prior to the curing of the cement or stucco wall surface. Four blade holders can be spaced to produce horizontal brick joints simultaneously with the two middle blades being removable, so that the two end blades can produce two vertical joints simultaneously.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
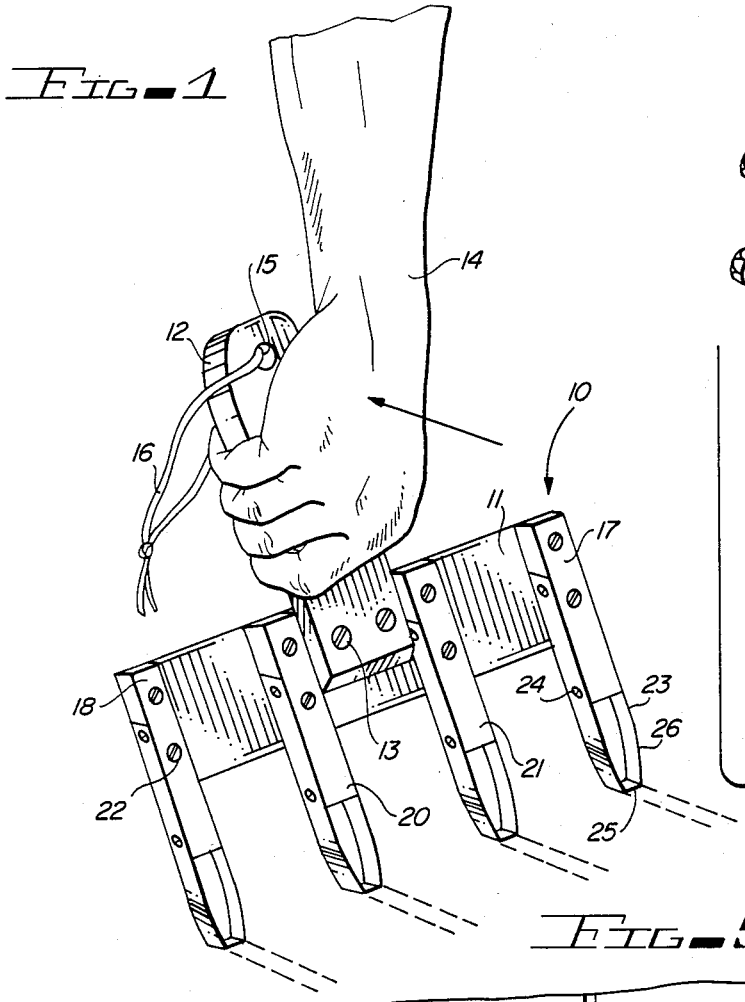
FIG. 1 is a perspective view of an apparatus for applying brick designs in accordance with the present invention.
Figure 3:
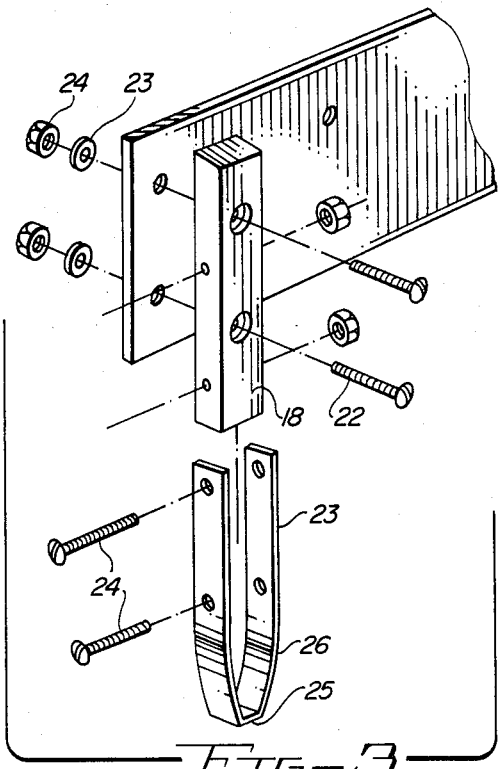
FIG. 3 is an exploded view of a blade holder and blade of the tool of FIG. 1.
Figure 4:
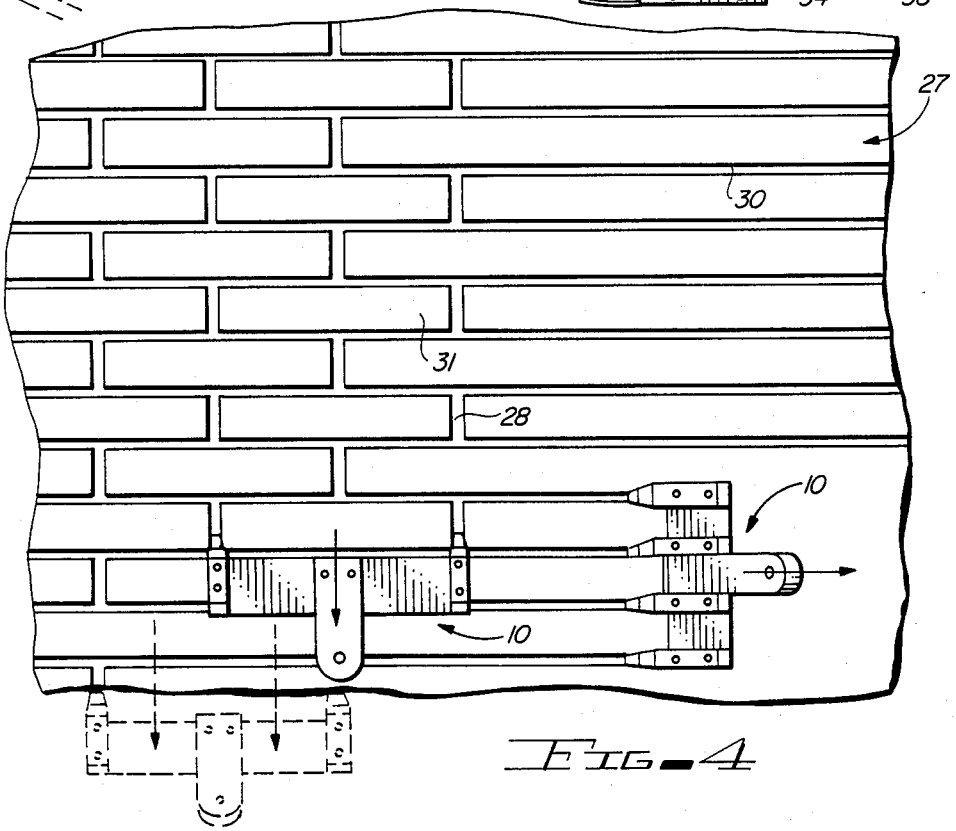
FIG. 4 is an elevation of a simulated brick wall being formed with the tool of FIG. 1.

Referring to the drawings, FIGS. 1 through 4 show a tool 10 for applying brick designs to a wall surface having a coating of stucco, cement, mortar, plaster or similar materials which includes a frame 11, which may be made of steel or any material desired, having a handle 12 attached thereto with bolts 13. The handle is held by a workman's hand 14 and has an aperture 15 passing therethrough with a leather thong 16 attached through the aperture 15 to the handle 12. The frame 11 may be a flat rectangular plate if desired and includes a pair of end blade arms 17 and 18 and a pair of inner blade arms 20 and 21. Each of the blade arms is attached to the frame 11 by a pair of bolts 22 having lock washers 23 and nuts 24, as shown in FIG. 3. Each blade arm 17, 18, 21 and 22 has a simulated joint cutting blade 23 attached thereto with a pair of bolts 24. Each blade 23 is a generally U-shaped having a flat bottom portion 25 and a pair of curved side portions 26 to form a predetermined shape simulating a mortared joint between bricks. The space between blade arms 17 and 21 and between 21 and 20 and between 18 and 20 are spaced the approximate distance for the height of a brick, so that when the tool is pulled across a cement or stucco wall, such as shown in FIG. 4, in a horizontal direction, where the cement or stucco has been recently applied and is still soft, it will create simulated brick joints. Advantageously, the arms 20 and 21 or the blades for the arms 20 and 21 can be easily removed so that only the blades from the arms 17 and 18 are in contact with the wall surface 27 in FIG. 4. This distance approximates the length of a brick and can be used in a vertical direction, as shown in FIG. 4, to form vertical joints 28.

Thus, as illustrated in FIG. 4, the horizontal joints 30 are being formed with all four blades attached to the frame and the vertical joints are being formed with the same tool having two blades or blade arms 21 and 22 removed to form a plurality of simulated bricks 31. The brick material can be precolored with coloring in the cement, stucco or mortar, or alternatively, can be colored after the simulated brick shapes are formed. A simulated brick wall as shown in FIG. 4 can be produced for a fraction of a cost of a brick wall or a brick facade on a wall and would generally have the same advantages of a kiln dried brick, in that it would not require painting or other expensive periodical coatings and would be long lasting.

Figure 5:
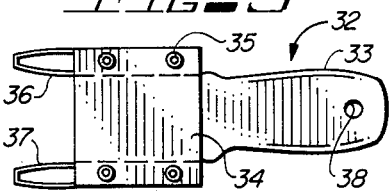
FIG. 5 is an elevational view of an alternate embodiment of the present invention.
Figure 2:
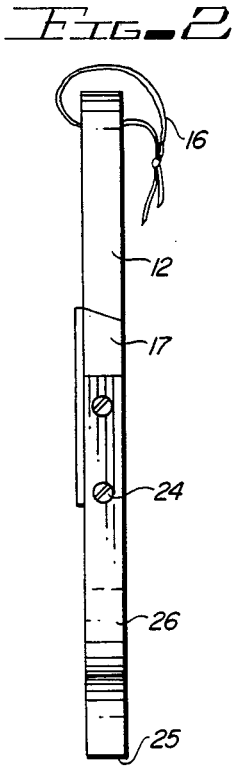
FIG. 2 is an end elevation of the tool of FIG. 1.

Turning to FIG. 5, an alternate embodiment of a tool 32 has a handle 33, a smaller frame 34 supporting a pair of blade arms with bolts 35, supporting blades 36 and 37 spaced the approximate distance for a horizontal joint 30. A separate tool could then be used for the vertical joints 28 of the wall 4. The tool in FIG. 5 also has an aperture 38 in the handle 33.

It should be clear at this time that a masonry working tool has been provided which has special shaped blades particularly made to form simulated bricks by cutting precision joints that would normally be between the bricks in both vertical and horizontal directions. It should, however, be clear that the present invention is not to be considered as limited to the forms shown, which are to be considered illustrative rather than restrictive.

I claim:

1. An apparatus for applying brick designs to a wall surface comprising in combination:

a handle;

a frame having the handle attached thereto;

a plurality of blade holders removably attached to the frame by threaded fasteners; and a plurality of U-shaped blades having arcuate sides and flat bottoms, each blade being removably attached to one blade holder by a threaded fastener, whereby brick designs can be applied to stucco, cement, plaster or mortar walls, or the like.

2. An apparatus in accordance with claim 1, in which four blade holders are attached to the frame supporting four blades for cutting four simulated brick joints.

3. An apparatus in accordance with claim 2, in which two of the four blades are removable to provide a space between the remaining two blades for cutting vertical simulated brick joints.

4. An apparatus in accordance with claim 1, in which said handle has an aperture therethrough.

5. An apparatus in accordance with claim 4, in which a flexible thong is attached through said aperture.

6. An apparatus in accordance with claim 1, in which the frame is a steel frame and each blade is a steel blade.

* * * * *